US007464561B1

(12) United States Patent
Butler et al.

(10) Patent No.: US 7,464,561 B1
(45) Date of Patent: Dec. 16, 2008

(54) UNITARY CONTROL FOR AIR CONDITIONER AND/OR HEAT PUMP

(75) Inventors: William P. Butler, St. Louis, MO (US); Dean A. Drake, St. Peters, MO (US); Nagaraj B. Jayanth, Sidney, OH (US)

(73) Assignee: Emerson Electric Co., St. Louis, MO (US)

( * ) Notice: Subject to any disclaimer, the term of this patent is extended or adjusted under 35 U.S.C. 154(b) by 33 days.

(21) Appl. No.: 11/514,607

(22) Filed: Sep. 1, 2006

Related U.S. Application Data

(62) Division of application No. 10/836,526, filed on Apr. 30, 2004, now Pat. No. 7,100,382.

(60) Provisional application No. 60/490,000, filed on Jul. 25, 2003.

(51) Int. Cl.
*F25D 17/00* (2006.01)
*F25B 49/00* (2006.01)

(52) U.S. Cl. ..... 62/181; 62/183; 62/228.1; 62/230; 236/1 E; 236/78 A

(58) Field of Classification Search ..... 62/228.1, 62/228.5, 181, 183, 230; 236/1 E, 78 R, 236/78 A; 307/127, 135, 141
See application file for complete search history.

(56) References Cited

U.S. PATENT DOCUMENTS

| | | | | | |
|---|---|---|---|---|---|
| 4,864,157 | A * | 9/1989 | Dickey | 307/135 |
| 5,064,998 | A * | 11/1991 | Holling | 219/519 |
| 5,676,196 | A * | 10/1997 | Jakubzick et al. | 165/11.1 |
| 5,821,642 | A * | 10/1998 | Nishhira et al. | 307/127 |
| 6,272,872 | B1 * | 8/2001 | Herrick et al. | 62/228.3 |
| 6,450,409 | B1 * | 9/2002 | Rowlette et al. | 236/1 E |
| 6,792,766 | B2 * | 9/2004 | Osborne et al. | 62/159 |
| 2007/0028635 | A1 * | 2/2007 | Gleesaon | 62/239 |

* cited by examiner

*Primary Examiner*—Marc E Norman
(74) *Attorney, Agent, or Firm*—Harness, Dickey & Pierce, P.L.C.

(57) ABSTRACT

A unitary control for operating at least the fan and compressor of a climate control apparatus in response to signals received from a thermostat. The unitary air conditioning control includes a circuit board, a microprocessor on the circuit board, a first relay on the circuit board operable by the microprocessor, to connect a fan connected thereto to line voltage, and having first and second contacts at least one of which is connected to the microprocessor; and a second relay on the circuit board operable by the microprocessor, to connect a compressor connected thereto to line voltage, and having first and second contacts connected to the microprocessor.

39 Claims, 6 Drawing Sheets

UNITARY CONTROL FOR AIR CONDITIONER AND/OR HEAT PUMP

CROSS REFERENCE TO RELATED APPLICATIONS

This application is a divisional application of U.S. patent application Ser. No. 10/836,526 filed on Apr. 30, 2004 now U.S. Pat. No. 7,100,382, which claims the benefit of U.S. Provisional Application No. 60/490,000 filed Jul. 25, 2003. The disclosures of the above applications are incorporated herein by reference.

BACKGROUND OF THE INVENTION

This invention relates to air conditioning and/or heat pump systems, and in particular to a unitary control for operating an air conditioning and/or heat pump system in response to signals received from a thermostat.

An air conditioning and/or heat pump system typically includes a compressor and condenser fan that are turned on and off by contactors in response to signals from a thermostat. These contactors are relatively expensive, and provide no other functionality except connecting and disconnecting the compressor motor and the condenser fan motor to electric power.

SUMMARY OF THE INVENTION

The present invention relates generally to a unitary control for air conditioning and/or heat pumps, to a combination of an air conditioning and/or heat pump system with a unitary control, to a climate control system including a thermostat, an air conditioning and/or heat pump, and a unitary control for operating the compressor and condenser fan motors, and to methods of operating the compressor and condenser fan motor.

Generally a unitary control in accordance with embodiments of this invention is adapted to receive signals from a thermostat, and operate at least the compressor motor and condenser fan motor of an air conditioning and/or heat pump system. In one preferred embodiment the unitary control comprises a circuit board; a microprocessor on the circuit board; a first relay on the circuit board operable by the microprocessor, to connect a fan connected thereto to line voltage, and having first and second contacts at least one of which is connected to the microprocessor; and a second relay on the circuit board operable by the microprocessor, to connect a compressor connected thereto to line voltage, and having first and second contacts at least one of which is connected to the microprocessor.

Generally, an air conditioning and/or heat pump and unitary control in accordance with embodiments of this invention comprises a motor driven compressor and a motor driven condenser fan, and a unitary control adapted to receive signals from a thermostat and operate at least the compressor motor and condenser fan motor. In one preferred embodiment the unitary control comprises a circuit board; a microprocessor on the circuit board; a first relay on the circuit board operable by the microprocessor, to connect a fan connected thereto to line voltage, and having first and second contacts at least one of which is connected to the microprocessor; a second relay on the circuit board operable by the microprocessor, to connect a compressor connected thereto to line voltage, and having first and second contacts at least one of which is connected to the microprocessor.

Generally, a climate control system in accordance with the present invention comprises a thermostat, an air conditioning and/or heat pump and unitary control in accordance with embodiments of this invention comprises a motor driven compressor and a motor driven condenser fan, and a unitary control adapted to receive signals from a thermostat and operate at least the compressor motor and condenser fan motor. In one preferred embodiment the unitary control comprises a circuit board; a microprocessor on the circuit board; a first relay on the circuit board operable by the microprocessor, to connect a fan connected thereto to line voltage, and having first and second contacts at least one of which is connected to the microprocessor; and a second relay on the circuit board operable by the microprocessor, to connect a compressor connected thereto to line voltage, and having first and second contacts at least one of which is connected to the microprocessor.

Generally, the method of operating an air conditioning and/or heat pump system in accordance with embodiments of this invention comprises selectively connecting the compressor motor and the condenser fan motor to electric current in response to signals from a thermostat. In one preferred embodiment the method comprises operating at least the condenser fan motor and compressor motor with relays on a circuit board with a microprocessor that controls the relays in response to a thermostat.

The unitary control used in the various aspects of this invention replaces prior electromechanical contactors, and provides reliable operation of at least the compressor motor and condenser fan motor in an air conditioning and/or heat pump system. In some embodiments, the microprocessor can operate a two stage air conditioning and/or heat pump system in response to a conventional signal stage thermostat. In other embodiments, the unitary control can automatically adjust the operation of the relays employed to prolong their life. In still other embodiments the unitary control can sense and respond to possible problems with the compressor, compressor motor, and/or condenser fan motor based on the sensed electric current provided to these components. In still other embodiments, the unitary control can automatically adjust the operation of the compressor, compressor motor, and/or condenser fan motor based sensed conditions, such as refrigerant temperature, or pressure, or ambient temperature. In additional the unitary control can be provided with communications capability to provide system information back to the thermostat, or on the control itself for service personnel.

These and other features and advantages will be in part apparent, and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
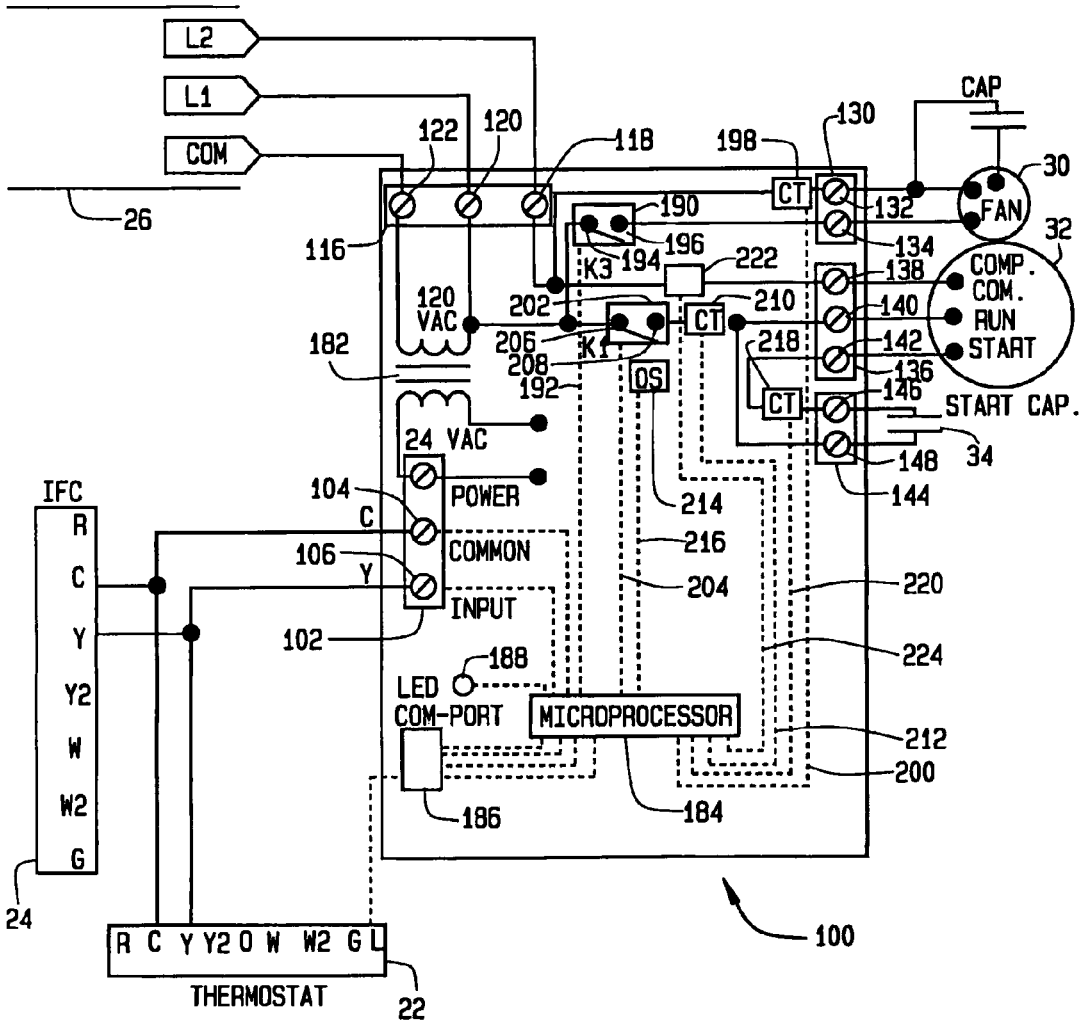
FIG. 1 is a schematic diagram of a first embodiment of a unitary control in accordance with the principles of this invention, adapted for use with a basic air conditioning system.

A first embodiment of unitary control in accordance with the principles of this invention, adapted for use with a basic air conditioning system, is indicated as 100 in FIG. 1. As shown in FIG. 1, the unitary control 100 is adapted to be connected to a thermostat 22 and optionally an Integrated Furnace Control 24. As shown in FIG. 1, the unitary control has input bus 102 with connections 104 and 106, for the common and input (C and Y) outputs from the thermostat 22, and a power terminal 108. (The connections between thermostat 22 and unitary controller 100 shown schematically in FIG. 1 can be hard wired, or they can be wireless connections.)

The unitary controller 100 also has a power bus 116 with terminals 118, 120 and 122 for connecting L2 and L1 and COM from a 220 VAC power source 26.

The unitary controller 100 also has a connector block 130 with two terminals 132 and 134 for connecting to a condenser fan 30; a connector block 136 with three terminals 138, 140 and 142 for connecting to common, run, and start leads of a compressor motor 32; and a connector block 144 with two terminals 146 and 148 for connection to a start capacitor 34.

As shown in FIG. 1, the controller 100 is preferably formed on a single circuit board and carries a 120V/24V transformer 182, a microprocessor 184, a corn port 186 and an LED 188 connected to the microprocessor. The microprocessor 184 may be a 28 pin PIC16F microprocessor manufactured by Microchip. The transformer 182 is connected to the power terminal 108 of the input bus 102. The terminals 104 and 106 of input bus 102 are also connected to the microprocessor 184.

A condenser fan relay 190 is connected to microprocessor 184 via connection 192. The relay may be a A22500P2 latching relay manufactured by American Zettler. The relay 190 has first and second contacts 194 and 196, at least one of which may be in communication with the microprocessor 184, and preferably at least the non-moving contact 196 of which is in communication with the microprocessor. As shown in FIG. 1, the first contact 194 of the condenser fan relay 190 is connected to 120 VAC line voltage (line L1 of 220 VAC line 26) via terminal 120 of connector block 116. The second contact 196 of the condenser fan relay 190 is connected to the terminal 134 of connector block 130, for electrical connection to one lead of condenser fan 30. A current transformer 198, connected to the microprocessor 184 via connection 200, is on the line between terminal 118 of connector block 116, and terminal 128 of the connector block 124. The terminal 128 is connected via run capacitor 28 to terminal 126 of the same connector block, which is connected to terminal 18 of connector 116, which is connected to line L2 of the 220 VAC source 26. When the condenser fan relay 190 is closed, the current transformer 198 provides a signal to the microprocessor 184 corresponding to the electric power drawn by the condenser fan motor 30.

A compressor motor relay 202 is connected to microprocessor 184 via connection 204. The relay 202 may be a A22500P2 latching relay manufactured by American Zettler. The relay 202 has first and second contacts 206 and 208, at least one of which may be in communication with the microprocessor 184, and preferably at least the non-moving contact 208 of which is in communication with the microprocessor. As shown in FIG. 1, the first contact 206 of the compressor motor relay 202 is connected to 120 VAC line voltage (line L1 of 220 VAC line 26) via terminal 120 of connector block 116. The second contact 208 of the compressor motor relay 202 is connected via a current to terminal 140 of connector block 136, for electrical connection to the run lead of compressor motor 32. A current transformer 210, connected to the microprocessor 184 via connection 212, is on the line between the relay 202 and terminal 140. A spark sensor, such as optical spark sensor 214, is connected to microprocessor 184 via connection 216, and detects sparks at the terminals of relay 202. The optical sensor 214 may be a silicon photo-transistor, such as an SD5553-003 photo-transistor manufactured by Honeywell. The second terminal 208 of relay 202 is also connected to terminal 148 of connector block 144, which is connected to terminal 146 of the same connector block with start capacitor 34. A current transformer 218, connected to the microprocessor 184 via connection 220, is on a line connected terminal 146 of connector block 144, with terminal 142 of connector block 136, to connect to the start lead of the compressor motor 32.

A current transformer 222, connected to the microprocessor 184 via connection 224, is on a line between terminal 118 of connector block 116 (which is connected to line L2 of 240 VAC source 26) and terminal 138 of connector block 136, for electrical connection to the common lead of the compressor motor 32.

The current transformers 198, 210, 218, and 222 may be TX-P095800C010 current transformers manufactured by ATR Manufacturing LTD.

Operation of the First Embodiment

In operation, when the temperature in the space monitored by the thermostat 22 rises above the set point temperature of the thermostat, the thermostat sends a signal to the microprocessor 184. The microprocessor 184 operates relay 190 via connection 192 to connect fan motor 30 on terminals 132 and 134 to line voltage. Because the relay 190 is on the same board as the microprocessor 184, the contacts 194 and 196 of the relay can be connected to the microprocessor, so that the microprocessor can determine when the relay 190 is open and when it is closed.

After the microprocessor opens or closes the relay 190, it can confirm that the relay is in fact open or closed with voltage/current signals from the contacts 194 and 196. Thus when the microprocessor sends a signal to close the relay 190, and does not detect line voltage or current on contact 196, the microprocessor can determine that the relay is not closed, and take appropriate action, e.g. sending a fault signal. Similarly, when the microprocessor sends a signal to open the relay 190, and still detects line voltage or current on contact 196, the microprocessor can determine that the relay is not open, and take appropriate predetermined action, e.g. sending a fault signal.

The current transformer 198 further provides the microprocessor with information about the current provided to the fan motor 30. With this information the microprocessor can detect existing or imminent problems with the fan motor 30, including for example start winding failure, run winding failure, and/or a seized rotor, and take appropriate predetermined action.

The microprocessor 184 also operates relay 202 via connection 204 to connect compressor motor 32 on terminals 138, 140, and 142 to 220 VAC. Because the relay 202 is on the same board as the microprocessor 184, the contacts 206 and 208 of the relay can be connected to the microprocessor, so that the microprocessor can determine when the relay 202 is open and when it is closed. The sensor 214 monitors the relay 202 for a spark, and provides the microprocessor 184 with information about the duration of the spark. The microprocessor can be programmed to reduce and/or to minimize the duration of the spark by adjusting the point at which the microprocessor signals the relay 202 to close relative to phase of the power line so that the relay closes at or close to the zero crossing to reduce arcing and thereby increase the life of the relay.

After the microprocessor opens or closes the relay 202, it can confirm that the relay is in fact open or closed with voltage/current signals from the contacts 206 and 208. Thus when the microprocessor sends a signal to close the relay 202, and does not detect line voltage or current on contact 208, the microprocessor can determine that the relay is not closed, and take appropriate action, e.g. sending a fault signal. Similarly, when the microprocessor sends a signal to open the relay 202, and still detects line voltage or current on contact 208, the microprocessor can determine that the relay is not open, and take appropriate action, e.g. sending a fault signal.

The current transformer 210 provides the microprocessor 184 with information about the current provided to the run winding of the compressor motor 32. The current transformer 218 provides the microprocessor 184 with information about the current provided to the start winding of the compressor motor 32. The current transformer 222 provides the microprocessor 184 with information about the current provided to the compressor common terminal of the compressor motor 32. With this information the microprocessor can detect existing or imminent problems with the compressor motor 32, including for example start winding failure, run winding failure, and/or a seized rotor, and take appropriate predetermined action.

Figure 2:
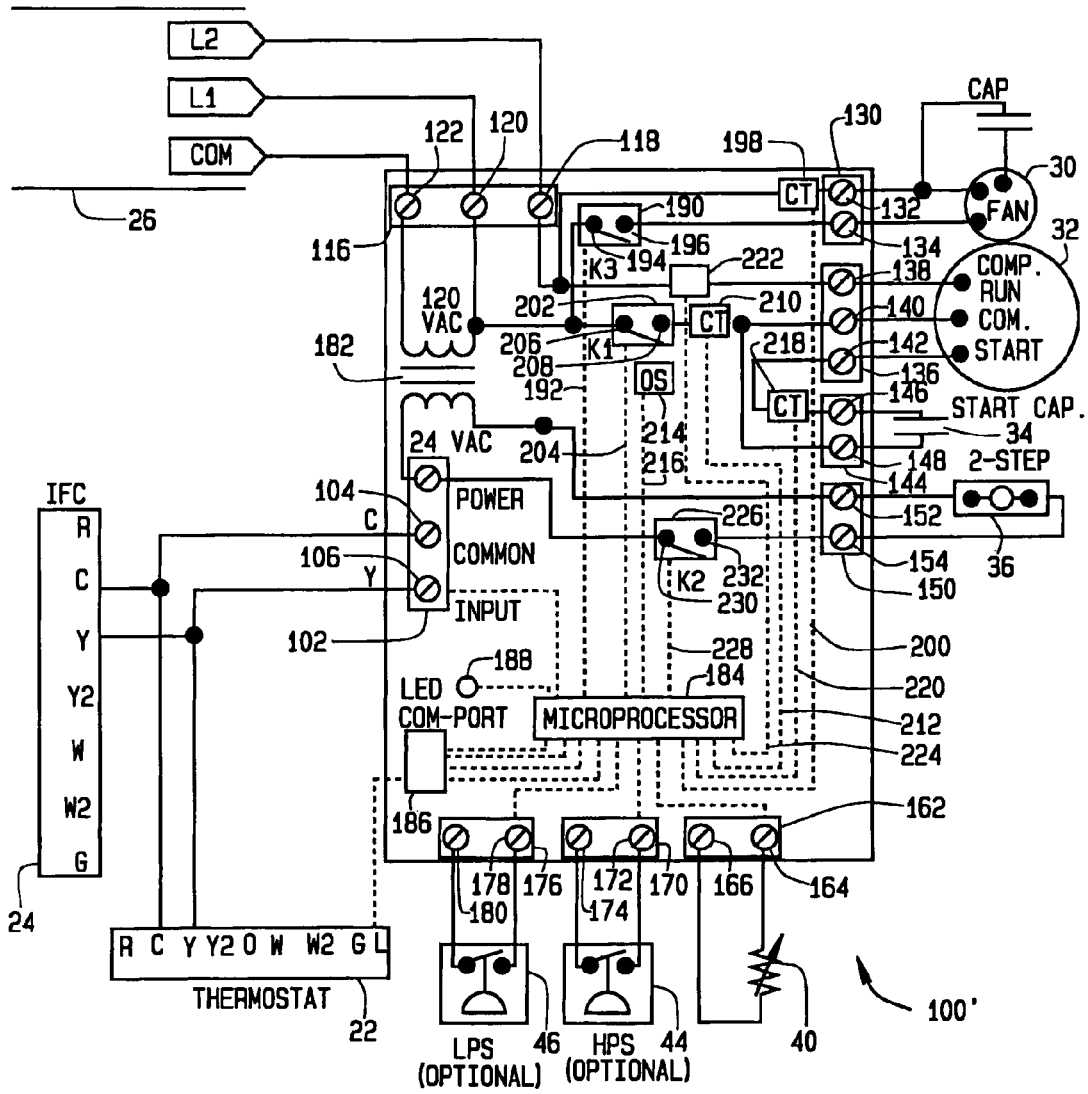
FIG. 2 is a schematic diagram of a second embodiment of a unitary control in accordance with the principles of this invention, adapted for use with a multistage air conditioning system.

A second embodiment of unitary control in accordance with the principles of this invention, adapted for use with a two stage air conditioning system, is indicated as 100' in FIG. 2. Unitary Control 100' is similar in construction to unitary control 100, and corresponding parts are identified with corresponding reference numerals. As shown in FIG. 2, the unitary control 100' is adapted to be connected to a thermostat 22 and optionally an Integrated Furnace Control 24. As shown in FIG. 2, the unitary control 100' has input bus 102 with connections 104 and 106, for the common and input (C and Y) outputs from the thermostat 22, and a power terminal 108. (The connections between thermostat 22 and unitary controller 100 shown schematically in FIG. 2 can be hard wired, or they can be wireless connections.)

The unitary controller 100' also has a power bus 116 with terminals 118, 120 and 122 for connecting L2 and L1 and COM from a 220 VAC power source 26.

The unitary controller 100' also has a connector block 130 with two terminals 132 and 134 for connecting to a condenser fan 30; a connector block 136 with three terminals 138, 140 and 142 for connecting to common, run, and start leads of a compressor motor 32; and a connector block 144 with two terminals 146 and 148 for connection to a start capacitor 34. In addition, controller 100' has a connector block 150 with two terminals 152 and 154 for connecting to the leads of a two stage compressor control 36; a connector block 162, having terminals 164 and 166 for connecting a temperature sensor 40 for compressor discharge temperature; a connector block 170. having terminals 172 and 174 for connecting an optional high pressure switch 44; and a connector block 176, having terminals 178 and 180 for connecting an optional low pressure switch 46. Provision could also be made for measuring the ambient air temperature.

As shown in FIG. 2, the controller 100' is preferably formed on a single circuit board and carries a 120V/24V transformer 182, a microprocessor 184, a com port 186 and an LED 188 connected to the microprocessor. The microprocessor 184 may be a 28 pin PIC16F microprocessor manufactured by Microchip. The transformer 182 is connected to the power terminal 108 of the input bus 102. The terminals 104 and 106 of input bus 102 are also connected to the microprocessor 184.

A condenser fan relay 190 is connected to microprocessor 184 via connection 192. The relay 190 may be a A22500P2 latching relay manufactured by American Zettler. The relay 190 has first and second contacts 194 and 196, at least one of which may be in communication with the microprocessor 184, and preferably at least the non-moving contact 196 of which is in communication with the microprocessor. As shown in FIG. 2, the first contact 194 of the condenser fan relay 190 is connected to 120 VAC line voltage (line L1 of 220 VAC line 26) via terminal 120 of connector block 116. The second contact 196 of the condenser fan relay 190 is connected to the terminal 134 of connector block 130, for electrical connection to one lead of condenser fan 30. A current transformer 198, connected to the microprocessor 184 via connection 200, is on the line between terminal 118 of connector block 116, and terminal 128 of the connector block 124. The terminal 128 is connected via run capacitor 28 to terminal 126 of the same connector block, which is connected to terminal 18 of connector 116, which is connected to line L2 of the 220 VAC source 26. When the condenser fan relay 190 is closed, the current transformer 198 provides a signal to the microprocessor 184 corresponding to the electric power drawn by the condenser fan motor 30.

A compressor motor relay 202 is connected to microprocessor 184 via connection 204. The relay 202 may be a A22500P2 latching relay manufactured by American Zettler. The relay 202 has first and second contacts 206 and 208, at least one of which may be in communication with the microprocessor 184, and preferably at least the non-moving contact 208 of which is in communication with the microprocessor. As shown in FIG. 1, the first contact 206 of the compressor motor relay 202 is connected to 120 VAC line voltage (line L1 of 220 VAC line 26) via terminal 120 of connector block 116. The second contact 208 of the compressor motor relay 202 is connected via a current to terminal 140 of connector block 136, for electrical connection to the run lead of compressor motor 32. A current transformer 210, connected to the microprocessor 184 via connection 212, is on the line between the relay 202 and terminal 140. A spark sensor, such as optical spark sensor 214, is connected to microprocessor 184 via connection 216, and detects sparks at the terminals of relay 202. The optical sensor 214 may be a silicon photo-transistor, such as an SD5553-003 photo-transistor manufactured by Honeywell. The second terminal 208 of relay 202 is also connected to terminal 148 of connector block 144, which is connected to terminal 146 of the same connector block with start capacitor 34. A current transformer 218, connected to the microprocessor 184 via connection 220, is on a line connected terminal 146 of connector block 144, with terminal 142 of connector block 136, to connect to the start lead of the compressor motor 32.

A current transformer 222, connected to the microprocessor 184 via connection 224, is on a line between terminal 118 of connector block 116 (which is connected to line L2 of 240

VAC source 26) and terminal 138 of connector block 136, for electrical connection to the common lead of the compressor motor 32.

A two step relay 226, connected to the microprocessor 184 via connection 228, has first and second contacts 230 and 232, at least one of which may be in communication with the microprocessor 184, and preferably at least the non-moving contact 232 of which is in communication with the microprocessor. The relay 226 may be a A22500P2 latching relay manufactured by American Zettler. Instead of relay 226, a a triac that is pulse width modulated can be used, which allows control over the power to the two-step solenoid so as to minimize heating of the solenoid. The relay 226 is connected between the common terminal 104 on the input bus 102, and the terminal 154 of the connector block 150, for selectively connected the two step selector 36, which is connected between terminals 152 and 154.

A connection 234 connects the compressor discharge temperature sensor 40 to the microprocessor, a connection 238 connects the high pressure switch 44 with the microprocessor, and a connection 240 connects the low pressure switch 66 with the microprocessor.

The current transformers 198, 210, 218, and 222 may be TX-P095800C010 current transformers manufactured by ATR Manufacturing LTD.

Operation of the Second Embodiment

In operation, when the temperature in the space monitored by the thermostat 22 rises above the set point temperature of the thermostat, the thermostat sends a signal to the microprocessor 184. The microprocessor 184 operates relay 190 via connection 192 to connect fan motor 30 on terminals 132 and 134 to line voltage. Because the relay 190 is on the same board as the microprocessor 184, the contacts 194 and 196 of the relay can be connected to the microprocessor, so that the microprocessor can determine when the relay 190 is open and when it is closed.

After the microprocessor opens or closes the relay 190, it can confirm that the relay is in fact open or closed with voltage/current signals from the contacts 194 and 196. Thus when the microprocessor sends a signal to close the relay 190, and does not detect line voltage or current on contact 196, the microprocessor can determine that the relay is not closed, and take appropriate action, e.g. sending a fault signal. Similarly, when the microprocessor sends a signal to open the relay 190, and still detects line voltage or current on contact 196, the microprocessor can determine that the relay is not open, and take appropriate predetermined action, e.g. sending a fault signal.

The current transformer 198 further provides the microprocessor with information about the current provided to the fan motor 30. With this information the microprocessor can detect existing or imminent problems with the fan motor 30, including for example start winding failure, run winding failure, and/or a seized rotor, and take appropriate predetermined action.

The microprocessor 184 also operates relay 202 via connection 204 to connect compressor motor 32 on terminals 138, 140, and 142 to 220 VAC. Because the relay 202 is on the same board as the microprocessor 184, the contacts 206 and 208 of the relay can be connected to the microprocessor, so that the microprocessor can determine when the relay 202 is open and when it is closed. The sensor 214 monitors the relay 202 for a spark, and provides the microprocessor 184 with information about the duration of the spark. The microprocessor can be programmed to reduce and/or to minimize the duration of the spark by adjusting the point at which the microprocessor signals the relay 202 to close relative to phase of the power line so that the relay closes at or close to the zero crossing to reduce arcing and thereby increase the life of the relay.

After the microprocessor opens or closes the relay 202, it can confirm that the relay is in fact open or closed with voltage/current signals from the contacts 206 and 208. Thus when the microprocessor sends a signal to close the relay 202, and does not detect line voltage or current on contact 208, the microprocessor can determine that the relay is not closed, and take appropriate action, e.g. sending a fault signal. Similarly, when the microprocessor sends a signal to open the relay 202, and still detects line voltage or current on contact 208, the microprocessor can determine that the relay is not open, and take appropriate action, e.g. sending a fault signal.

The current transformer 210 provides the microprocessor 184 with information about the current provided to the run winding of the compressor motor 32. The current transformer 218 provides the microprocessor 184 with information about the current provided to the start winding of the compressor motor 32. The current transformer 222 provides the microprocessor 184 with information about the current provided to the compressor common terminal of the compressor motor 32. With this information the microprocessor can detect existing or imminent problems with the compressor motor 32, including for example start winding failure, run winding failure, and/or a seized rotor, and take appropriate predetermined action.

In a two stage air conditioning system, as shown in FIG. 2, a two stage thermostat is 32 will send a signal for second stage cooling to the microprocessor 184, and the microprocessor will send a signal via connection 228 to relay 226 to operate second stage switch 36 connected to terminals 152 and 154. Because the relay 226 is on the same board as the microprocessor 184, the contacts 230 and 232 of the relay can be connected to the microprocessor, so that the microprocessor can determine when the relay 226 is open and when it is closed. However, when the thermostat is a single stage thermostat, the microprocessor can measure the duration of the signal for cooling from the thermostat, and after a predetermined pattern of demand, operate relay 226 to turn on or off second stage cooling. For example, the microprocessor can time the duration of the signal from the thermostat for cooling, and if the duration exceeds a predetermined threshold, operate relay 226 to turn on second stage cooling. However, the microprocessor can operate second stage cooling in response to a particular frequency of calls for cooling, and can even factor in ambient temperature (if such an input is provided to the microprocessor) in determining whether to actuate relay 226 to provide second stage cooling.

After the microprocessor opens or closes the relay 226, it can confirm that the relay is in fact open or closed with voltage/current signals from the contacts 230 and 232. Thus when the microprocessor sends a signal to close the relay 226, and does not detect voltage or current on contact 232, the microprocessor can determine that the relay is not closed, and take appropriate action, e.g. sending a fault signal. Similarly, when the microprocessor sends a signal to open the relay 226, and still detects voltage or current on contact 232, the microprocessor can determine that the relay is not open, and take appropriate action, e.g. sending a fault signal.

Figure 3:
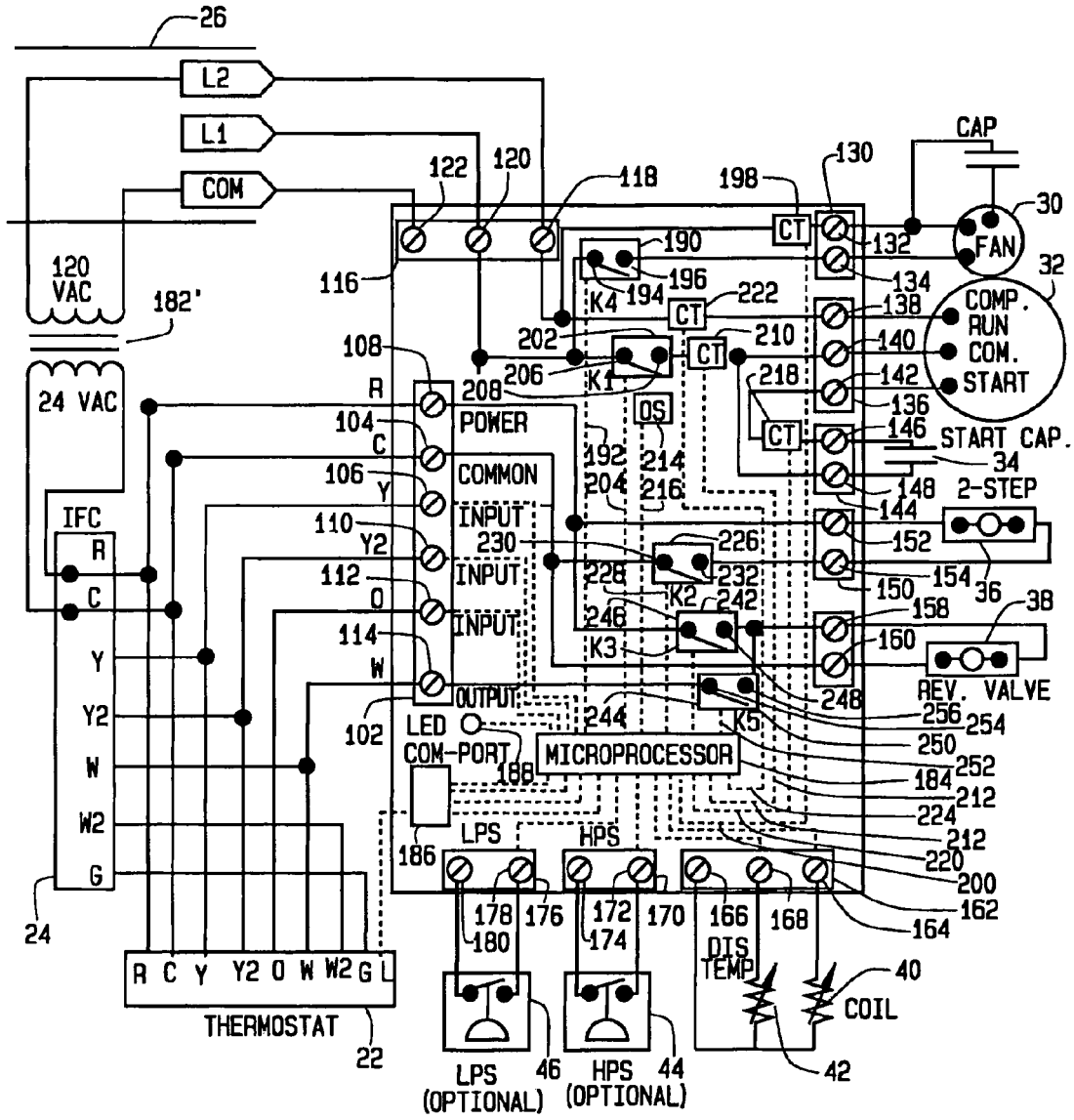
FIG. 3 is a schematic diagram of a third embodiment of a unitary control in accordance with the principles of this invention, adapted for use with a heat pump system.

A third embodiment of unitary control in accordance with the principles of this invention, adapted for use with a two stage air conditioning system, is indicated as 100" in FIG. 3. Unitary Control 100" is similar in construction to unitary controls 100 and 100', and corresponding parts are identified with corresponding reference numerals. As shown in FIG. 3, the unitary control 100" is adapted to be connected to a thermostat 22 and optionally an Integrated Furnace Control 24. As shown in FIG. 3, the unitary control 100" has input bus 102 with connections 104 and 106, for the common and input (C and Y) outputs from the thermostat 22, a power terminal 108, for connection to the R output from the thermostat, terminals 110 and 112 for the Y2 and O inputs from the thermostat 22, and terminal 114, for connection to the W input of thermostat 22. (The connections between thermostat 22 and unitary controller 100 shown schematically in FIG. 2 can be hard wired, or (with the exception of the power connection between R and terminal 108) they can be wireless connections.)

The unitary controller 100" also has a power bus 116 with terminals 118, 120 and 122 for connecting L2 and L1 and COM from a 220 VAC power source 26.

The unitary controller 100" also has a connector block 124 with two terminals 126 and 128 for connecting to a run capacitor 28; a connector block 130 with two terminals 132 and 134 for connecting to a condenser fan 30; a connector block 136 with three terminals 138, 140 and 142 for connecting to common, run, and start leads of a compressor motor 32; a connector block 144 with two terminals 146 and 148 for connection to a start capacitor 34; a controller 100" has a connector block 150 with two terminals 152 and 154 for connecting to the leads of a two stage compressor control 36. In addition, control 100" has a connector block 156, with terminals 158 and 160 for connecting a reversing valve 38. The controller 100" also has a connector block 162, having terminals 164, 166, and 168 for connecting compressor discharge sensor 40 and a coil temperature sensor 42; a connector block 170. having terminals 172 and 174 for connecting an optional high pressure switch 44; and a connector block 176, having terminals 178 and 180 for connecting an optional low pressure switch 46. Provision could also be made for sensing ambient air temperature as well.

As shown in FIG. 3, the controller 100" is preferably formed on a single circuit board and carries a microprocessor 184, a corn port 186 and an LED 188 connected to the microprocessor. The microprocessor 184 may be a 28 pin PIC16F microprocessor manufactured by Microchip. A transformer 182' is connected to the R and C terminals of the integrated furnace control, which in turn is connected to the power terminal 108 and common terminal 104 of the of the input bus 102. The terminals 104 and 106 of input bus 102 are also connected to the microprocessor 184.

A condenser fan relay 190 is connected to microprocessor 184 via connection 192. The relay 190 may be a A22500P2 latching relay manufactured by American Zettler. The relay 190 has first and second contacts 194 and 196, at least one of which may be in communication with the microprocessor 184, but preferably at least the non-moving contact 196 of which is in communication with the microprocessor. As shown in FIG. 2, the first contact 194 of the condenser fan relay 190 is connected to 120 VAC line voltage (line L1 of 220 VAC line 26) via terminal 120 of connector block 116. The second contact 196 of the condenser fan relay 190 is connected to the terminal 134 of connector block 130, for electrical connection to one lead of condenser fan 30. A current transformer 198, connected to the microprocessor 184 via connection 200, is on the line between terminal 118 of connector block 116, and terminal 128 of the connector block 124. The terminal 128 is connected via run capacitor 28 to terminal 126 of the same connector block, which is connected to terminal 118 of connector 116, which is connected to line L2 of the 220 VAC source 26. When the condenser fan relay 190 is closed, the current transformer 198 provides a signal to the microprocessor 184 corresponding to the electric power drawn by the condenser fan motor 30.

A compressor motor relay 202 is connected to microprocessor 184 via connection 204. The relay 202 may be a A22500P2 latching relay manufactured by American Zettler. The relay 202 has first and second contacts 206 and 208, at least one of which may be in communication with the microprocessor 184, and preferably at least the non-moving contact 208 of which is in communication with the microprocessor. As shown in FIG. 1, the first contact 206 of the compressor motor relay 202 is connected to 120 VAC line voltage (line L1 of 220 VAC line 26) via terminal 120 of connector block 116. The second contact 208 of the compressor motor relay 202 is connected via a current to terminal 140 of connector block 136, for electrical connection to the run lead of compressor motor 32. A current transformer 210, connected to the microprocessor 184 via connection 212, is on the line between the relay 202 and terminal 140. A spark sensor, such as optical spark sensor 214, is connected to microprocessor 184 via connection 216, and detects sparks at the terminals of relay 202. The optical sensor 214 may be a silicon photo-transistor, such as an SD5553-003 photo-transistor manufactured by Honeywell. The second terminal 208 of relay 202 is also connected to terminal 148 of connector block 144, which is connected to terminal 146 of the same connector block with start capacitor 34. A current transformer 218, connected to the microprocessor 184 via connection 220, is on a line connected terminal 146 of connector block 144, with terminal 142 of connector block 136, to connect to the start lead of the compressor motor 32.

A current transformer 222, connected to the microprocessor 184 via connection 224, is on a line between terminal 118 of connector block 116 (which is connected to line L2 of 220 VAC source 26) and terminal 138 of connector block 136, for electrical connection to the common lead of the compressor motor 32.

A two step relay 226, connected to the microprocessor 184 via connection 228, has first and second contacts 228 and 230, at least one of which may be in communication with the microprocessor 184, and preferably at least the non-moving contact 208 of which is in communication with the microprocessor. The relay 226 may be a A22500P2 latching relay manufactured by American Zettler. Instead of relay 226, a triac that is pulse width modulated can be used, which allows control over the power to the two-step solenoid so as to minimize heating of the solenoid. The relay 226 is connected between the common terminal 104 on the input bus 102, and the terminal 154 of the connector block 150, for selectively connected the two step selector 36, which is connected between terminals 152 and 154.

A connection 234 connects the compressor discharge sensor 40 to the microprocessor, a connection 236 connects the coil temperature sensor 42 to the microprocessor, a connection 238 connects the high pressure switch 44 with the microprocessor, and a connection 240 connects the low pressure switch 66 with the microprocessor.

A first reversing valve relay 242, connected to the microprocessor 184 via connection 244, has first and second contacts 246 and 248, at least one of which may be in communication with the microprocessor 184, and preferably at least the non-moving contact 248 of which is in communication with the microprocessor. The relay 242 may be a A22500P2 latching relay manufactured by American Zettler. The relay 242 is disposed between terminal 108 on the input bus 102, and terminal 158 on connector block 156, for connection to the reversing valve 38. A second reversing valve relay 250, connected to the microprocessor 184 via connection 252, has first and second contacts 254 and 256, at least one of which may be in communication with the microprocessor 184, and preferably at least the non-moving contact 256 of which is in communication with the microprocessor. The relay 252 may be a A22500P2 latching relay manufactured by American Zettler. The relay 252 is disposed between terminal 114 on the input bus 102, and terminal 160 on connector block 156, for connection to the reversing valve 38.

A connection 232 connects the compressor discharge sensor 40 to the microprocessor, a connection 236 connects the high pressure switch 44 with the microprocessor, and a connection 238 connects the low pressure switch 66 with the microprocessor.

The current transformers 198, 210, 218, and 222 may be TX-P095800C010 current transformers manufactured by ATR Manufacturing LTD.

Operation of the Third Embodiment

In operation, when the temperature in the space monitored by the thermostat 22 rises above the set point temperature of the thermostat, the thermostat sends a signal to the microprocessor 184. The microprocessor 184 operates relay 190 via connection 192 to connect fan motor 30 on terminals 132 and 134 to line voltage. Because the relay 190 is on the same board as the microprocessor 184, the contacts 194 and 196 of the relay can be connected to the microprocessor, so that the microprocessor can determine when the relay 190 is open and when it is closed.

After the microprocessor opens or closes the relay 190, it can confirm that the relay is in fact open or closed with voltage/current signals from the contacts 194 and 196. Thus when the microprocessor sends a signal to close the relay 190, and does not detect line voltage or current on contact 196, the microprocessor can determine that the relay is not closed, and take appropriate action, e.g. sending a fault signal. Similarly, when the microprocessor sends a signal to open the relay 190, and still detects line voltage or current on contact 196, the microprocessor can determine that the relay is not open, and take appropriate predetermined action, e.g. sending a fault signal.

The current transformer 198 further provides the microprocessor with information about the current provided to the fan motor 30. With this information the microprocessor can detect existing or imminent problems with the fan motor 30, including for example start winding failure, run winding failure, and/or a seized rotor, and take appropriate predetermined action.

The microprocessor 184 also operates relay 202 via connection 204 to connect compressor motor 32 on terminals 138, 140, and 142 to 220 VAC. Because the relay 202 is on the same board as the microprocessor 184, the contacts 206 and 208 of the relay can be connected to the microprocessor, so that the microprocessor can determine when the relay 202 is open and when it is closed. The sensor 214 monitors the relay 202 for a spark, and provides the microprocessor 184 with information about the duration of the spark. The microprocessor can be programmed to reduce and/or to minimize the duration of the spark by adjusting the point at which the microprocessor signals the relay 202 to close relative to phase of the power line so that the relay closes at or close to the zero crossing to reduce arcing and thereby increase the life of the relay.

For example, the duration of the spark may be used as an offset value that is added to a delay value used to adjust timing for the next actuation of switching means (e.g., latching means of the microprocessor 184) for actuating the relay 202 relative to the line voltage zero crossing. If the delay value exceeds one line cycle, a fractional part of the delay value may be used for the subsequent actuation. If no arcing is detected by the sensor 214, the foregoing offset value is substantially zero and the delay value remains substantially constant.

A method of determining whether the sensor 214 is operating as intended may be performed, for example, periodically and/or after an appropriate number of actuations has been performed. The microprocessor may subtract an appropriate offset value from a current delay value. The foregoing step may be repeated for a plurality of cycles of the line voltage. If a feedback signal from the sensor 214 is detected, the delay value can be recalculated to restore an appropriate value for relay control using the sensor 214. If no feedback signal is detected, another control method may be used as further described below. While an another control method is in use, if a feedback signal is restored, for example, for a predetermined number of cycles, the microprocessor may revert to relay control using the sensor 214.

Figure 4:
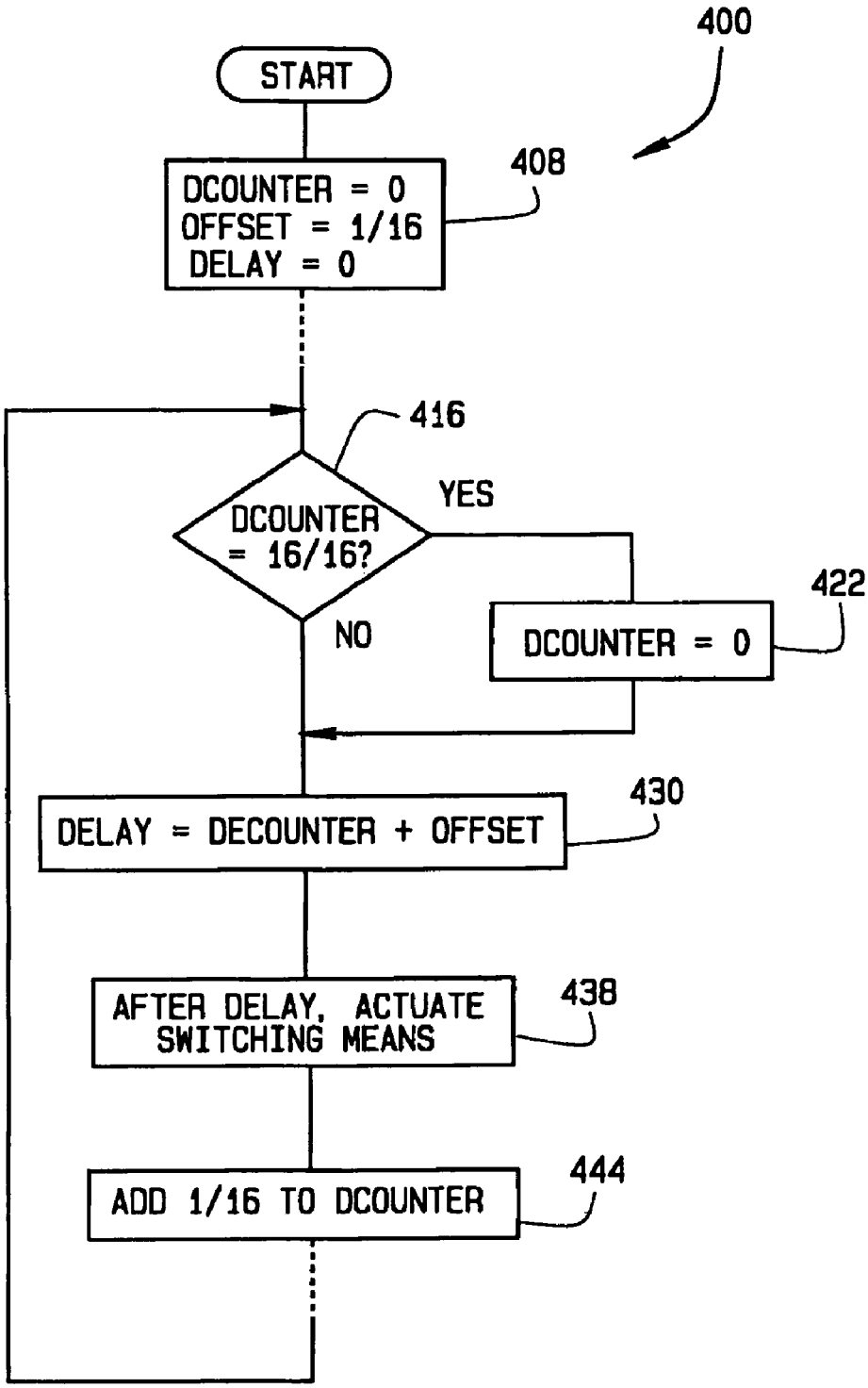
FIG. 4 is a flow diagram of a first implementation of a method of operating a switching means to control a relay.

In the event that the sensor 214 is not operational or is not being relied upon, other methods of controlling the switching means may be used. For example, one implementation of a method of operating a switching means to control the relay 202 is indicated generally in FIG. 4 by reference number 400. Generally, a first actuation of the switching means is delayed by a delay time referenced from a zero crossing of the line voltage. The delay time is incremented, and a second actuation of the switching means is delayed by the incremented delay time referenced from a zero crossing of the line voltage. A delay increment ("Offset") may be a fraction of a single line cycle period, for example, 1/16 of a period as exemplified in FIG. 4. A delay counter ("DCounter") also may be a fraction of a single line cycle period. At step 408, several values are initialized. At step 416, it is determined whether DCounter has reached a value of 1, representing a full line cycle period (in the present example, 16/16). If yes, at step 422 DCounter is reset to zero. At step 430, a Delay value is set to the sum of DCounter and Offset. At step 438, after waiting through a time period measured by the Delay value, the microprocessor actuates the switching means. At step 444, Dcounter is incremented by 1/16 and control is returned to step 416. Thus the Delay value is set to the following values: 1/16, 2/16, 3/16 . . . , etc., and can be reset to zero at completion of a full line cycle period. Because the Delay time is incremented at each actuation of the switching means, switching transients tend to be averaged and material transfer in the switching means tends to be balanced over time. Many implementations are possible, including implementations in which negative delay counters, negative offsets and/or other fractional values are used.

Figure 5:
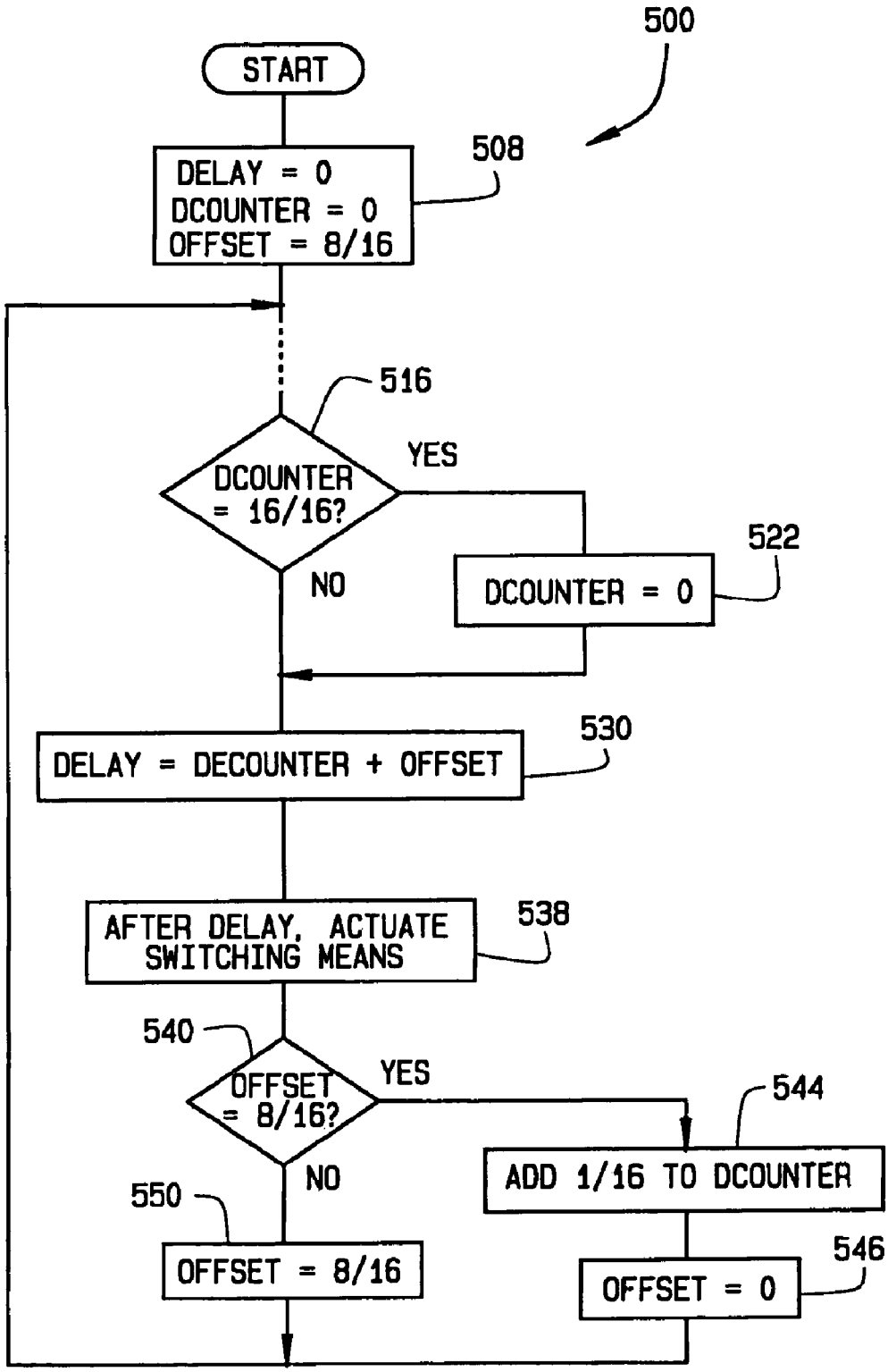
FIG. 5 is a flow diagram of a second implementation of a method of operating a switching means to control a relay.
Figure 6:
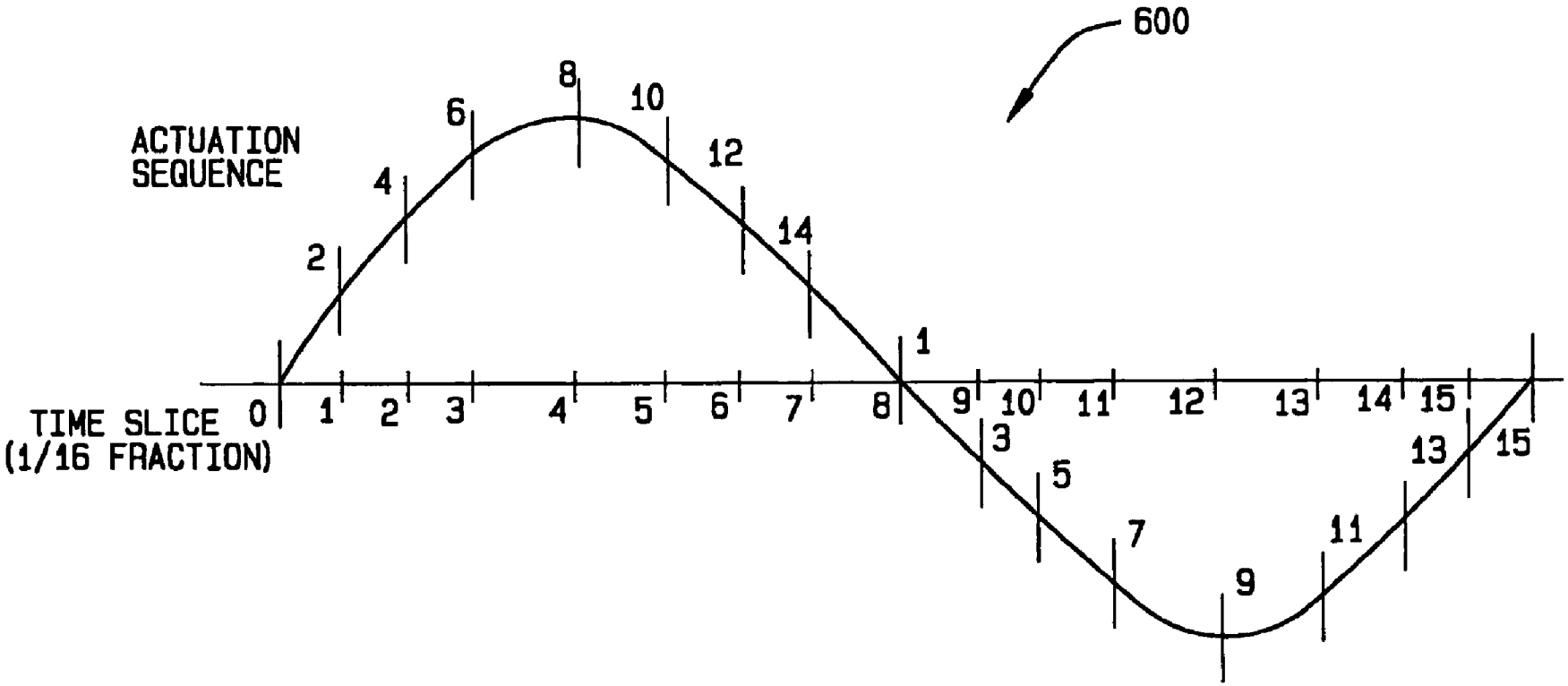
FIG. 6 is a diagram of an actuation sequence relative to a line voltage cycle, in accordance with one implementation of a method of operating a switching means to control a relay.

Another implementation of a method of operating a switching means to control the relay 202 is indicated generally in FIG. 5 by reference number 500. Generally, a variable time increment is added to a line voltage cycle offset. In such manner, a delay time may be made phase-specific. A number of increments are added which are equal to one-half of the total fractions by which the line cycle is divided for actuation delays. Using the method 500, a delay counter is incremented every other cycle and an additional offset of one-half line cycle is added every other cycle. Thus current direction can be reversed through the switching means, and material transfer occurs in opposite directions, on successive actuations of the switching means. A delay increment ("Offset") may be in fractions of a single line cycle period, for example, 1/16 of a period as exemplified in FIG. 5. A delay counter ("DCounter") also may be in fractions of a single line cycle period. At step 508, several values are initialized. At step 516, it is determined whether DCounter has reached a value of 1 (in the present example, 16/16). If yes, at step 522 DCounter is reset to zero. At step 530, a Delay value is set to the sum of DCounter and Offset. At step 538, after waiting through a time period measured by the Delay value, the microprocessor actuates the switching means. At step 540, it is determined whether Offset equals a value of one-half a cycle of the line voltage. If yes, at step 544, DCounter is incremented by 1/16, and at step 546 Offset is set to zero. If at step 540 Offset does not equal 8/16, then at step 550 Offset is set to 8/16. Control is returned to step 516. Thus the Delay value is set to the following values: 8/16, 1/16, 9/16, 2/16, 10/16 . . . , etc., and can be reset to zero at completion of a full line cycle period. A diagram of the foregoing actuation sequence relative to a line voltage cycle is indicated generally in FIG. 6 by reference number 600. A partial list of exemplary values associated with the method 500 is shown in Table 1 as follows.

TABLE 1

| ACTUATION SEQUENCE | DCOUNTER | OFFSET | CURRENT DIRECTION | DELAY |
|---|---|---|---|---|
| 1 | 0 | 8/16 | + | 8/16 |
| 2 | 1/16 | 0 | − | 1/16 |
| 3 | 1/16 | 8/16 | + | 9/16 |
| 4 | 2/16 | 0 | − | 2/16 |
| 5 | 2/16 | 8/16 | + | 10/16 |
| ETC. | | | | |

Many implementations are possible, including implementations in which negative delay counters, negative offsets and/or other fractional values are used.

After the microprocessor opens or closes the relay 202, it can confirm that the relay is in fact open or closed with voltage/current signals from the contacts 206 and 208. Thus when the microprocessor sends a signal to close the relay 202, and does not detect line voltage or current on contact 208, the microprocessor can determine that the relay is not closed, and take appropriate action, e.g. sending a fault signal. Similarly, when the microprocessor sends a signal to open the relay 202, and still detects line voltage or current on contact 208, the microprocessor can determine that the relay is not open, and take appropriate action, e.g. sending a fault signal.

The current transformer 210 provides the microprocessor 184 with information about the current provided to the run winding of the compressor motor 32. The current transformer 218 provides the microprocessor 184 with information about the current provided to the start winding of the compressor motor 32. The current transformer 222 provides the microprocessor 184 with information about the current provided to the compressor common terminal of the compressor motor 32. With this information the microprocessor can detect existing or imminent problems with the compressor motor 32, including for example start winding failure, run winding failure, and/or a seized rotor, and take appropriate predetermined action.

In a heat pump system with two stage cooling, as shown in FIG. 3, a two stage thermostat is 32 will send a signal for second stage cooling to the microprocessor 184, and the microprocessor will send a signal via connection 228 to relay 226 to operate second stage switch 36 connected to terminals 152 and 154. Because the relay 226 is on the same board as the microprocessor 184, the contacts 230 and 232 of the relay can be connected to the microprocessor, so that the microprocessor can determine when the relay 226 is open and when it is closed. However, when the thermostat is a single stage thermostat, the microprocessor can measure the duration of the signal for cooling from the thermostat, and after a predetermined pattern of demand, operate relay 226 to turn on or off second stage cooling. For example, the microprocessor can time the duration of the signal from the thermostat for cooling, and if the duration exceeds a predetermined threshold, operate relay 226 to turn on second stage cooling. However, the microprocessor can operate second stage cooling in response to a particular frequency of calls for cooling, and can even factor in ambient temperature (if such an input is provided to the microprocessor) in determining whether to actuate relay 226 to provide second stage cooling.

After the microprocessor opens or closes the relay 226, it can confirm that the relay is in fact open or closed with voltage/current signals from the contacts 230 and 232. Thus when the microprocessor sends a signal to close the relay 226, and does not detect voltage or current on contact 232, the microprocessor can determine that the relay is not closed, and take appropriate action, e.g. sending a fault signal. Similarly, when the microprocessor sends a signal to open the relay 226, and still detects voltage or current on contact 232, the microprocessor can determine that the relay is not open, and take appropriate action, e.g. sending a fault signal.

In response to a change in demand from heat to cooling, or vice versa, from the thermostat 22, the microprocessor 184 operates relay 242 via connection 244, or relay 252, via connection 254, to operate the reversing valve connected to terminals 158 and 160, to change is mode of operation from heating to cooling, or vice versa. Because the relays 242 and 252 are on the same board as the microprocessor 184, the contacts 246 and 248 of relay 242 and 256 and 258 of relay 252 can be connected to the microprocessor, so that the microprocessor can determine when the relays 242 and 252 are open and when they are closed.

After the microprocessor opens or closes the relay 242, it can confirm that the relay is in fact open or closed with voltage/current signals from the contacts 246 and 248. Thus when the microprocessor sends a signal to close the relay 242, and does not detect voltage or current on contact 248, the microprocessor can determine that the relay is not closed, and take appropriate action, e.g. sending a fault signal. Similarly, when the microprocessor sends a signal to open the relay 242, and still detects voltage or current on contact 248, the microprocessor can determine that the relay is not open, and take appropriate action, e.g. sending a fault signal.

Similarly, After the microprocessor opens or closes the relay 252, it can confirm that the relay is in fact open or closed with voltage/current signals from the contacts 256 and 258. Thus when the microprocessor sends a signal to close the relay 252, and does not detect voltage or current on contact 258, the microprocessor can determine that the relay is not closed, and take appropriate action, e.g. sending a fault signal. Similarly, when the microprocessor sends a signal to open the relay 252, and still detects voltage or current on contact 258, the microprocessor can determine that the relay is not open, and take appropriate action, e.g. sending a fault signal.

The microprocessor can also factor signals received from the condenser coil temperature sensor 42, the compressor discharge sensor 40, the high pressure switch 22 and the low pressure switch 46 to determine the state of the system and take the appropriate action, which can include sending fault signals, and or sequencing the system through one or more corrective actions. For example the various inputs to the microprocessor can indicate that the coils have frozen, and the microprocessor can automatically implement a defrost cycle. Alternatively, the various inputs to the microprocessor may indicate that the fan motor 30 or compressor motor 32 is not operating correctly, that in system with two stage cooling that the system did not successfully switch from first stage to second stage cooling (or vice versa), or in a heat pump system that the system did not successfully switch from heating to cooling (or vice versa). The microprocessor can switch parts of the system off and on again, or take other action to attempt to fix the problem, and/or shut the system down and/or send a fault signals.

The unitary control of each of the three embodiments allows the microprocessor to implement a wide variety of diagnostic tests and corrective actions and/or alarms, some of which are summarized in Table 2:

TABLE OF MALFUNCTIONS, DETECTION SCHEMES, AND REMDIAL ACTIONS BY UNITARY CONTROLLER

| MALFUNCTION | SYMPTOMS | ACTION |
|---|---|---|
| | AIR CONDITIONING SYSTEMS | |
| Relay 190 fails to close | Microprocessor sent close signal via connection 192 but voltage/current at contact 196 is not correct. | 1. Microprocessor opens and recluses contact. 2. Microprocessor sends fault signal. |
| Relay 202 fails to close | Microprocessor sent close signal via connection 202 but voltage/current at contact 208 is not correct. | 1. Microprocessor opens and recluses contact. 2. Microprocessor sends fault signal. |
| Relay 226 fails to close | Microprocessor sent close signal via connection 228 but voltage/current at contact 232 is not correct. | 1. Microprocessor opens and recluses contact. 2. Microprocessor sends fault signal. |
| Relay 242 fails to close | Microprocessor sent close signal via connection 244 but voltage/current at contact 248 is not correct. | 1. Microprocessor opens and recluses contact. 2. Microprocessor sends fault signal. |
| Relay 250 fails to close | Microprocessor sent close signal via connection 252 but voltage/current at contact 256 is not correct. | 1. Microprocessor opens and recluses contact. 2. Microprocessor sends fault signal. |
| Rotor of compressor motor locked | Microprocessor detects predetermined number (e.g. 4) of consecutive starts where current transformer 210 senses loss of current after predetermined time (e.g. 4 to 10 seconds) indicating motor protector has tripped | 1. Microprocessor sends fault signal. |
| Start winding failure | Microprocessor detects that current transformer 218 does not detect current to start winding after microprocessor has closed relay 202 | 1. Microprocessor sends fault signal. |
| Start Capacitor failure | Microprocessor detects that current transformer 218 does not detect current to start winding after microprocessor has closed relay 202 | 1. Microprocessor sends fault signal. |
| Compressor over-current | Microprocessor compares current sensed by current transformer 210 to known current requirement for compressor to determine whether overload current level reached (indicative of refrigerant over charge) | 1. Microprocessor sends fault signal. |
| Compressor under-current | Microprocessor compares current sensed by current transformer 210 to known current requirement for compressor to determine whether under current level reached (indicative of low side fault such as lack of refrigerant, blocked flow control valve) | 1. Microprocessor sends fault signal. |
| Low Refrigerant Charge | Microprocessor detects based on temperature sensors 40 and 42, that temperature different is not in expected range | 1. Microprocessor sends fault signal. |
| Condenser coil frozen | Microprocessor detects that temperature sensed by temperature sensor 40 is not in expected range | 1. Microprocessor sends fault signal. |
| Short Cycling | Microprocessor stores run times and determines that running average of stored run time for a predetermined number of cycles (e.g. 10) is below threshold (e.g. 3 minutes) | 1. Microprocessor sends fault signal. |
| Long Run Time | Microprocessor stores run time and determines that any run time exceed predetermined threshold (e.g. 18 hours) | 1. Microprocessor shuts down system. 2. Microprocessor sends fault signal. |
| | HEAT PUMP SYSTEMS | |
| Coil Frozen | Microprocessor detects that temperature sensed by temperature sensor 42 is below threshold temperature | 1. Microprocessor initiates defrost cycle for (a) predetermined time, (b) until the sensed temperature reaches a predetermined level; or (c) when the microprocessor determines that the current measured by the current transformer 210 reaches a predetermined level |

The various fault signals can be communicated by the microprocessor using various color and blinking patterns for LED 188, or through com port 186 for communication to the thermostat and/or download by a service technician.

What is claimed is:

1. A unitary control for operating at least the fan and compressor of a climate control apparatus in response to signals received from a thermostat, the unitary air conditioning control comprising:

a circuit board;

a microprocessor on the circuit board;

a first relay on the circuit board operable by the microprocessor, to connect a fan connected thereto to line voltage, and having first and second contacts at least one of which is connected to the microprocessor;

a second relay on the circuit board operable by the microprocessor, to connect a compressor connected thereto to line voltage, and having first and second contacts connected to the microprocessor;

the microprocessor configured to operate the second relay relative to the phase of the line voltage and without input as to arcing duration, if any, to reduce arcing at the contacts of the second relay.

2. The unitary control according to claim 1 further comprising a current transformer on the circuit board in series with the first relay and connected to the microprocessor, for generating a signal related to the current conducted through the relay to a fan connected thereto.

3. The unitary control according to claim 1 further comprising a current transformer on the circuit board in series with the second relay and connected to the microprocessor, for generating a signal related to the current conducted through the relay to a compressor.

4. The unitary control according to claim 1, further comprising a spark sensor connected to the microprocessor for sensing arcing at the contacts of the second relay, and wherein the microprocessor is further programmed to subtract an offset from a current delay value associated with the second relay for each of a plurality of line voltage cycles; and if a signal from the spark sensor is detected, recalculate the delay value to provide for operation of the second relay using the spark sensor.

5. The unitary control according to claim 1 further comprising a spark sensor connected to the microprocessor for sensing arcing at the contacts of the second relay, the microprocessor configured to operate the second relay to reduce arcing at the contacts of the second relay without reference to input, if any, from the spark sensor.

6. The unitary control according to claim 1 wherein the processor is programmed to:

delay a first actuation of the second relay by a delay time referenced from a zero crossing of the line voltage;

increment the delay time by an increment; and delay a second actuation of the second relay by the incremented delay time referenced from a zero crossing of the line voltage.

7. The unitary control according to claim 6 wherein the processor is further programmed to:

change the increment;

increment the incremented delay time by the changed increment to obtain a changed delay time; and delay a third actuation of the second relay by the changed delay time referenced from a zero crossing of the line voltage.

8. The unitary control according to claim 7 wherein to change the increment comprises to change a delay offset to reverse a direction in which current flows through a means for switching the second relay.

9. The unitary control according to claim 1 further comprising a connector for connecting the microprocessor to a refrigerant pressure sensor.

10. The unitary control according to claim 1 further comprising a connector connecting the microprocessor to a refrigerant temperature sensor.

11. The unitary control according to claim 1 further comprising a connector for connecting the microprocessor to an outdoor temperature sensor.

12. The unitary control according to claim 1 further comprising a third relay connected to the microprocessor on the circuit board operable by the microprocessor, to connect a fan connected thereto to line voltage, and having first and second contacts at least one of which is connected to the microprocessor.

13. The unitary control according to claim 1 further comprising fourth and fifth relays, connected to the microprocessor on the circuit board and operable by the microprocessor, to connect a reversing valve connected thereto to a source of low voltage power.

14. In combination with a climate control apparatus comprising at least a fan and a compressor, a unitary air conditioning control for operating the climate control apparatus in response to a thermostat, the unitary control comprising:

a circuit board;

a microprocessor on the circuit board;

a first relay on the circuit board operable by the microprocessor, to connect a fan connected thereto to line voltage, and having first and second contacts at least one of which is connected to the microprocessor;

a second relay on the circuit board operable by the microprocessor, to connect a compressor connected thereto to line voltage, and having first and second contacts at least one of which is connected to the microprocessor;

the microprocessor configured to operate the second relay relative to the phase of the line voltage and without input as to arcing duration, if any, to reduce arcing at the contacts of the second relay.

15. The combination according to claim 14 wherein the unitary control further comprises a current transformer on the circuit board in series with the first relay and connected to the microprocessor, for generating a signal related to the current conducted through the relay to a fan connected thereto.

16. The combination according to claim 14 wherein the unitary control further comprises a current transformer on the circuit board in series with the second relay and connected to the microprocessor, for generating a signal related to the current conducted through the relay to a compressor.

17. The combination according to claim 14, further comprising a spark sensor connected to the microprocessor for sensing arcing at the contacts of the second relay, and wherein the microprocessor is further programmed to subtract an offset from a current delay value associated with the second relay for each of a plurality of line voltage cycles; and if a signal from the spark sensor is detected, recalculate the delay value to provide for operation of the second relay using the spark sensor.

18. The combination according to claim 14 further comprising a spark sensor connected to the microprocessor, for sensing arcing at the contacts of the second relay, the microprocessor configured to operate the second relay to reduce arcing at the contacts of the second relay without reference to input, if any, from the spark sensor.

19. The combination according to claim 14 wherein the processor is programmed to:

delay a first actuation of the second relay by a delay time referenced from a zero crossing of the line voltage;

increment the delay time by an increment; and delay a second actuation of the second relay by the incremented delay time referenced from a zero crossing of the line voltage.

20. The combination according to claim 19 wherein the processor is further programmed to:

change the increment;

increment the incremented delay time by the changed increment to obtain a changed delay time; and delay a third actuation of the second relay by the changed delay time referenced from a zero crossing of the line voltage.

21. The combination according to claim 20 wherein to change the increment comprises to change a delay offset to reverse a direction in which current flows through a means for switching the second relay.

22. The combination according to claim 14 wherein the unitary control further comprises a connector for connecting the microprocessor to a refrigerant pressure sensor.

23. The combination according to claim 14 wherein the unitary control further comprises a connector connecting the microprocessor to a refrigerant temperature sensor.

24. The combination according to claim 14 wherein the unitary control further comprises a connector for connecting the microprocessor to an outdoor temperature sensor.

25. The combination according to claim 14 wherein the unitary control further comprises a third relay connected to the microprocessor on the circuit board operable by the microprocessor, to connect a fan connected thereto to line voltage, and having first and second contacts at least one of which is connected to the microprocessor.

26. The combination according to claim 14 wherein the unitary control further comprises fourth and fifth relays, connected to the microprocessor on the circuit board and operable by the microprocessor, to connect a reversing valve connected thereto to a source of low voltage power.

27. A climate control system comprising:

a thermostat;

a climate control apparatus comprising at least a fan and a compressor;

a unitary control for operating at least the fan and the compressor of the climate control apparatus, the unitary control comprising a circuit board;

a microprocessor on the circuit board;

a first relay on the circuit board operable by the microprocessor, to connect a fan connected thereto to line voltage, and having first and second contacts at least one of which is connected to the microprocessor;

a second relay on the circuit board operable by the microprocessor, to connect a compressor connected thereto to line voltage, and having first and second contacts at least one of which is connected to the microprocessor;

the microprocessor configured to operate the second relay relative to the phase of the line voltage and without input as to arcing duration, if any, to reduce arcing at the contacts of the second relay.

28. The combination according to claim 27 wherein the unitary control further comprises a current transformer on the circuit board in series with the first relay and connected to the microprocessor, for generating a signal related to the current conducted through the relay to a fan connected thereto.

29. The combination according to claim 27 wherein the unitary control further comprises a current transformer on the circuit board in series with the second relay and connected to the microprocessor, for generating a signal related to the current conducted through the relay to a compressor.

30. The climate control system according to claim 27, further comprising a spark sensor connected to the microprocessor for sensing arcing at the contacts of the second relay, and wherein the microprocessor is further programmed to subtract an offset from a current delay value associated with the second relay for each of a plurality of line voltage cycles; and if a signal from the spark sensor is detected, recalculate the delay value to provide for operation of the second relay using the spark sensor.

31. The climate control system according to claim 30 further comprising a spark sensor connected to the microprocessor, for sensing arcing at the contacts of the second relay, the microprocessor configured to operate the second relay to reduce arcing at the contacts of the second relay without reference to input, if any, from the spark sensor.

32. The climate control system according to claim 27 wherein the processor is programmed to:

delay a first actuation of the second relay by a delay time referenced from a zero crossing of the line voltage;

increment the delay time by an increment; and delay a second actuation of the second relay by the incremented delay time referenced from a zero crossing of the line voltage.

33. The climate control system according to claim 32 wherein the processor is further programmed to:

change the increment;

increment the incremented delay time by the changed increment to obtain a changed delay time; and delay a third actuation of the second relay by the changed delay time referenced from a zero crossing of the line voltage.

34. The climate control system according to claim 33 wherein to change the increment comprises to change a delay offset to reverse a direction in which current flows through a means for switching the second relay.

35. The combination according to claim 27 wherein the unitary control further comprises a connector for connecting the microprocessor to a refrigerant pressure sensor.

36. The combination according to claim 27 wherein the unitary control further comprises a connector connecting the microprocessor to a refrigerant temperature sensor.

37. The combination according to claim 27 wherein the unitary control further comprises a connector for connecting the microprocessor to an outdoor temperature sensor.

38. The combination according to claim 27 wherein the unitary control further comprises a third relay connected to the microprocessor on the circuit board operable by the microprocessor, to connect a fan connected thereto to line voltage, and having first and second contacts at least one of which is connected to the microprocessor.

39. The combination according to claim 27 wherein the unitary control further comprises fourth and fifth relays, connected to the microprocessor on the circuit board and operable by the microprocessor, to connect a reversing valve connected thereto to a source of low voltage power.

* * * * *